United States Patent [19]

Rorden et al.

[11] Patent Number: 4,823,125

[45] Date of Patent: Apr. 18, 1989

[54] METHOD AND APPARATUS FOR STABILIZING A COMMUNICATION SENSOR IN A BOREHOLE

[75] Inventors: Louis H. Rorden; Henry S. More, both of Los Altos, Calif.

[73] Assignee: Develco, Inc., San Jose, Calif.

[21] Appl. No.: 68,433

[22] Filed: Jun. 30, 1987

[51] Int. Cl.[4] ..... G01V 1/00

[52] U.S. Cl. ..... 340/854; 340/855; 367/81; 367/911; 166/250; 33/304

[58] Field of Search ..... 33/302, 304; 73/151; 166/250; 367/25, 35, 36, 37, 911, 912, 83, 85, 86, 76, 77, 854, 855; 181/102, 104, 105; 340/854, 855; 324/333, 338, 339, 342; 364/422

[56] References Cited

U.S. PATENT DOCUMENTS

| | | | |
|---|---|---|---|
| 2,000,716 | 5/1935 | Polk . | |
| 2,096,279 | 10/1937 | Karcher . | |
| 2,096,359 | 10/1937 | Hawthorn . | |
| 2,400,170 | 5/1946 | Silverman . | |
| 2,568,241 | 9/1951 | Martin . | |
| 3,323,327 | 6/1967 | Leathers et al. . | |
| 3,926,265 | 12/1975 | Bouyoucos . | |
| 4,066,995 | 1/1978 | Matthews . | |
| 4,348,672 | 9/1982 | Givler . | |
| 4,365,321 | 12/1982 | Van Bose . | |
| 4,399,692 | 8/1983 | Hulsing, II et al. | 73/151 |
| 4,672,752 | 6/1987 | Hulsing, II et al. | 33/302 |
| 4,690,214 | 9/1987 | Wittrisch | 166/250 |
| 4,711,305 | 12/1987 | Ringgenberg | 166/250 |

*Primary Examiner*—Deborah L. Kyle
*Assistant Examiner*—John W. Eldred
*Attorney, Agent, or Firm*—Cushman, Darby & Cushman

[57] ABSTRACT

A method and apparatus for stabilizing a communication sensor in a borehole is described. The principle embodiment described includes a pair of centralizers at opposite ends of the housing for the communication sensor to maintain each of such respective ends at a constant lateral displacement from the borehole casing. A pair of flexible joints are provided to isolate the communication sensor to decouple the component to be protected from any motion and/or forces secured to the same urging it from the centralized position.

20 Claims, 3 Drawing Sheets

METHOD AND APPARATUS FOR STABILIZING A COMMUNICATION SENSOR IN A BOREHOLE

BACKGROUND OF INVENTION

This invention relates generally to controlling the orientation of assemblies, such as valves and associated components, of the type suspended in a borehole. More particularly, it relates to a method and apparatus for insuring that a communication sensor or other component of an assembly suspended within a borehole, such as a gas or oil production well, retains a fixed angular orientation relative to such borehole.

It is often desirable to provide in a production gas or oil well, a component of some sort down the borehole adjacent, for example, an oil bearing strata from which a desired product is being produced. This component may simply be a safety valve or the like to selectably stop the flow of crude oil through the production tubing. It also may be monitoring instrumentation, some of which is relatively sophisticated, which gathers desired information relating to the borehole or the product. In any event, it is necessary to communicate with such apparatus from the surface.

Various mechanisms for providing downhole communication have been designed and used. The reliability of these mechanisms, though, generally is a function of the depth of the communication. That is, the reliability of a communication between a downhole apparatus and the location on a surface between which a communication is desired, is dependent upon the distance between such locations. Thus, deep communication has not in the past been as reliable as desired. Many of such mechanisms have used hydraulic communication via flowing product. A difficulty with this type of mechanism is that typically there must be well casing penetration or other fluid accessability at the well head in order to provide physical access for such communication. Thus, the well head is exposed to blow-out. An electric control line is sometimes provided, extending from the surface to the downhole apparatus. There are additional problems associated with control of this type. For example, the installation of wire linkage can be difficult—for example, it is typical that the linkage be installed with the individual string sections making up the production tubing as they are lowered into the borehole. Breakage often occurs either during such installation or later.

It is known that it is desirable to provide wireless communication, e.g., communication via an electromagnetic link, with the downhole location. The reliability of wireless communication is limited, however, when the electrical component of an electromagnetic wave is detected to obtain the desired information. The earth, the medium through which essentially all of such communication takes place, includes many anomalies responsible for interference with such an electrical component of an information signal. Moreover, the metallic casing used to line boreholes effectively shields an electric sensor from such a component.

One way of avoiding the problems of the detection of the electrical component of an electromagnetic wave for communications purposes, is to detect the magnetic component of such a wave. U.S. Pat. No. 3,967,201 naming Louis H. Rorden, an inventor hereof, as the inventor is directed to such a communication scheme. This communication typically is achieved utilizing a magnetic sensor at the downhole location.

It is important in achieving reliable communication that stray noise and interference which can be picked up by the downhole sensor be minimized. The magnetic components of electromagnetic signals used for communication typically are at relatively low frequencies, e.g., below 1 kilohertz. Communication at low frequencies is especially prone to noise interference since low frequency noise is more easily induced or otherwise present in downhole environments. For example, at low frequencies mechanical vibrations of the production tubing and even of the earth can result in interference.

The generation of stray noise is particularly a problem in downhole communications since the sensor often is a component of a safety valve or other assembly suspended from a tailpipe section of production tubing, which in turn, is typically suspended below a packer in the fluid being produced. Vibration easily can be induced in such suspended members. Such vibration can create noise which will interfere with the reliable operation of the communication link.

SUMMARY OF THE INVENTION

The present invention provides a method and apparatus for maintaining a component of a member extending in a borehole at a fixed or stable angular orientation. From the broad standpoint, the method of the invention includes orienting the component in a fixed orientation, and maintaining two spaced portions of the component at fixed or constant later displacements from the borehole casing, i.e., the boundary of the borehole. The component can be, for example, a communication sensor such as a magnetic antenna. The two spaced portions are desirably at the ends of the housing for the component and, most desirably, the component is decoupled from those motions and forces on the production tubing or other suspension member urging all or part of the component toward a different angular orientation than that which is desired.

It has been found that if both ends of the component are maintained at constant lateral displacements from the borehole casing, the total component will be maintained in the fixed orientation irrespective of whether or not each of the ends is maintained in such a way that but for the other end, pivoting in the borehole relative to such end would be permitted. That is, as will become apparent from the more detailed description, if only a single portion of the component was maintained at a constant lateral displacement from the boundary the component could pivot relative to the borehole, the use of spaced stabilizing means prevents such pivoting. Stabilization of the ends has been found to be particularly important, since vibration of either end an amplitude of 1/1000 of an inch can produce substantial noise interference in a communication sensor. If the component is located in a fluid flow environment, such as within a crude oil production well below the tailpipe section of the production tubing, it is preferred that the stabilizers center the component to be stabilized on the axis of the borehole. Such a location will assure symmetry and minimize deleterious affects of turbulence or other disturbances in the flowing fluid. Moreover, decoupling the component from the motion and forces on the tailpipe section and the remainder of the suspended assembly, significantly aids the effort to maintain the component in a stable orientation.

The apparatus includes means for maintaining each end of the component at a constant lateral displacement from the borehole boundary, thereby maintaining the component in a fixed orientation. It further most desirably includes means for decoupling the component from any motion and forces provided by any member secured to the same urging the component toward a different angular orientation. Each of the means for maintaining a respective end of the component at a constant lateral displacement from the borehole casing most simply can be a stabilizing mechanism, such as a centralizer or decentralizer of the type now used in connection with well surveying. The decoupling is achieved by providing flexible joints or the like which cooperate with the remainder of the downhole structure to isolate the component from such motion and forces.

While the invention is particularly applicable to maintaining a communication sensor such as an antenna in a fixed orientation to minimize the generation of noise in the communication link, it also can be used to maintain other components, such as position sensing or flow monitoring instrumentation, in a fixed orientation. Moreover, in some instances it may be desirable to prevent vibration induced in parts of suspension members, such as in a tailpipe section or an assembly suspended therefrom, from being transmitted to other parts of the same, irrespective of whether or not a communication or monitoring component is provided in the part which is isolated.

The above features and advantages, as well as many others, will be described or will become apparent from the following more detailed description.

DETAILED DESCRIPTION OF PREFERRED EMBODIMENTS

Figure 1:
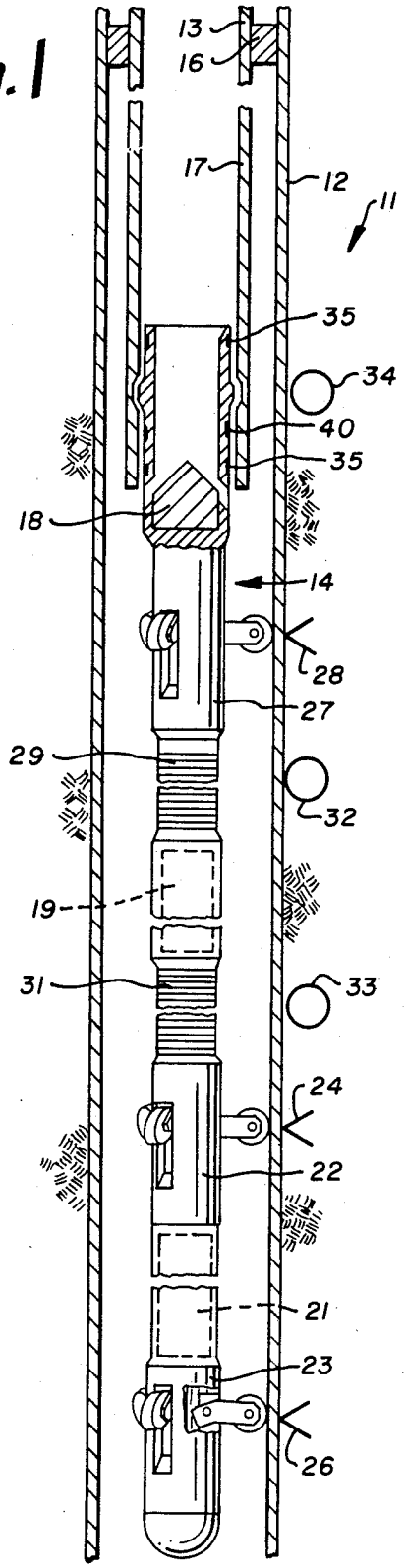
FIG. 1 is an idealized schematic sectional and broken-away view illustrating the principles of the invention.

FIG. 1 illustrates a preferred embodiment of the apparatus incorporating the principles of the invention. A borehole for a production or exploration well is generally referred to by the reference numeral 11. Such borehole includes, as is usual, a metallic lining or casing 12 adhered in position as by cementing. Such casing typically is provided in sections, and when a borehole is completed extends beyond the depth of interest, e.g., below the depth from which crude oil is to be produced in a production well. It will be noted that the casing essentially is a right circular cylinder. Once a casing is installed and cemented in place its inner surface provides what is, in essence, the boundary of the borehole.

Production tubing 13 extends along the axis of the borehole downward to a safety valve and or other component assembly, generally referred to by the reference numeral 14. In a production well as illustrated, a packer 16 is provided to close the volume between the production tubing and the borehole casing. Such production tubing typically includes a tailpipe section 17 extending below the packer 16. The embodiment of the invention illustrated in FIG. 1 is particularly useful with arrangements in which the tailpipe section is relatively long, e.g., 10 meters or more.

In a production well, physical communication via holes or the like to oil bearing strata having the crude oil to be raised to the surface is provided through the casing 12 below the packer 16. The result is that the lower portion of the borehole containing the tailpipe section and the component assembly will be filled with the petroleum product to be produced, which product then will flow upward through the production tubing 13 to the surface.

The component assembly 14 includes a safety valve 18 or the like to enable flow of the product into the production tubing to be stopped. Such an assembly also often will include an electronic or instrumentation section as represented by the dotted line block 19 to provide one or more different functions. In the embodiment being described, such section includes communication electronics responsive to appropriate electrical signals by controlling operation of valve 18. A communication sensor for receiving information signals from controlling electronics on the surface is provided in a different section, as is represented at 21. Such sensor could be active or passive, e.g., a fluxgate magnetometer or a magnetic dipole antenna such as a search coil or a solenoid with or without a magnetic core, designed to sense the magnetic component of an electromagnetic signal.

As discussed in the aforementioned U.S. Pat. No. 3,967,201, the magnetic component of an electromagnetic communication signal is particularly useful for downhole communication, in view of its ability to penetrate electrically conductive substances such as borehole casing 12. Such a component, though, provides a relatively weak signal at the location of the sensor. The result is that noise or the like at the sensor location could interfere with such signal and affect the reliability of the communication. For example, the turbulent flow of gas or oil past the valve will induce vibration in the mechanical tailpipe assembly containing the sensor. Moreover, any rotation of the sensor about an axis mutually perpendicular to its axis of magnetic field sensitivity and to a component of the earth's magnetic field at the sensor location will induce a noise voltage in such sensor. Displacement of the sensor in an ambient magnetic field will similarly induce a voltage in such sensor if there is a displacement-direction gradient of the field component in the sensitivity direction of the sensor.

The present invention inhibits vibration of the sensor and other movement which will induce noise voltage. To this end, a pair of stabilizing mechanisms 22 and 23 are provided at opposite ends of the housing for the sensor 21. The stabilizing mechanisms maintain at least two spaced portions of the sensor assembly, preferably the two ends of the sensor housing, at constant lateral displacements from the inner surface of the borehole casing. While such stabilizing mechanisms can be of many different types which will provide rigid positional support relative to the borehole at their location, it is preferred that they be centralizers which will maintain the sensor centrally along the axis of the borehole. The resulting symmetry will minimize coupling to large-scale pressure fluctuations, such as to acoustic resonance in the annulus between the packer and the valve. This symmetry also will minimize mechanical coupling of tailpipe and component assembly motion to the sensor, as well as decouple the sensor from magnetic anomalies, such as residual fields caused by casing collars, the tailpipe, and other components made of magnetic material. (Most desirably all parts of the component assembly which extend below the tailpipe are made from non-magnetic material except, of course, the communication sensor itself.)

To facilitate an understanding of the principles of the invention, the point of engagement of the stabilizers 22 and 23 with the production tubing 13 are indicated by wedge representations 24 and 26. A third centralizer 27 providing initial motion and force stabilization is included as part of the component assembly 14 adjacent valve 18. The engagement of such third centralizer with the production tubing is represented by wedge 28. Means are also provided for decoupling the sensor from lateral motion of, and forces on, the tailpipe section or component assembly urging all or part of it toward a different angular orientation than that maintained by the centralizers. To this end, a pair of flexible joints 29 and 31 are provided at opposite ends of the electronics section 19. These points allow free pivotal movement of the section 19 in any direction. Thus, any lateral motion of the tailpipe or the component assembly above the joint 29 will be prevented by the combination of the electronic section 19 and the flexible joints 29 and 30, from reaching the communication sensor 21 and the two stabilizing mechanisms 22 and 23. That is, flex joints 29 and 31 allow the electronics section 19 to pivot as required relative to the centralizer 22 to accommodate such motion, without passing it or the forces responsible for the same to the stabilizing mechanisms or, more importantly, to the sensor 21. They are represented in FIG. 1 by circles 32 and 33. (It should be noted that the design of each of the flexible joints itslef should be free of generation of shocks or rattles that could represent deleterious communication noise during operation by the joint.

An understanding of operation of the construction of the invention can be gained most simply by considering the various stabilizers as pivots and the rigid sections between joints as beams, and analyzing the linkage composed of the various joints, beams and pivots as shown. In this connection, because of the necessary clearance between the tailpipe and the component assembly, the connection itself can be considered to be a joint at which rotation can be expected. This joint is represented in the figures by circle 34. In the conventional design metal-to-metal contact at the connection between the tailpipe and component assembly will result from vibration, with attendant shock waves that could couple noise into the sensor. It is therefore desirable that elastomeric bumpers 35 be provided in the contact areas to reduce the generation of contact shocks and to damp the natural mechanical resonance peaks by absorbing energy. These bumpers are in addition to the normal packaging provided at such connection, represented at 40.

It will be seen by considering the various joints, beams and pivots as represented by the wedges 24–28 and the circles 32–34 that although the tailpipe and the component assembly are free to vibrate in various modes determined by length, stiffness, mass loading, and mechanical coupling, the housing for the sensor 21 is essentially isolated from such motion. For the purpose of this analysis the centralizers should be assumed to constrain transverse motion, while allowing rotation about the transverse axis and the negligable second order axial motion that will accompany transverse oscillation of the tailpipe. It should also be noted that the same degrees of freedom are present in the transverse direction not shown (perpendicular to the drawing sheet), but that some of the parameters, such as stiffness, pivot points, and moments of inertia, are not necessarily the same. Thus, modal frequencies and coupling coefficients could be different in different transverse directions and cross coupling can occur, resulting in very complex motion of the parts.

Centralizers have been provided in the past to centralize instrumentation and the like for well surveying. For example, reference is made to U.K. published British patent application No. 2173533A filed Apr. 4, 1986 and published Oct. 15, 1986. The selection of a particular design for optimization will depend, of course, on the design of other structural components. It is important, however, that the design selected provide rigid connection between the component assembly and the casing. Most desirably, the centralizer design will have three or more arms linked together that are erected by a common spring that is at least strong enough to lift the weight of the assembly to assure that it will be centered and held rigidly regardless of its inclination. If there are three of such arms, they define a plane which is transverse to the axis of the borehole/component assembly. Again, most desirably, this plane is normal to such axis so that the arms do not introduce a torsional force on the assembly.

Figure 3:
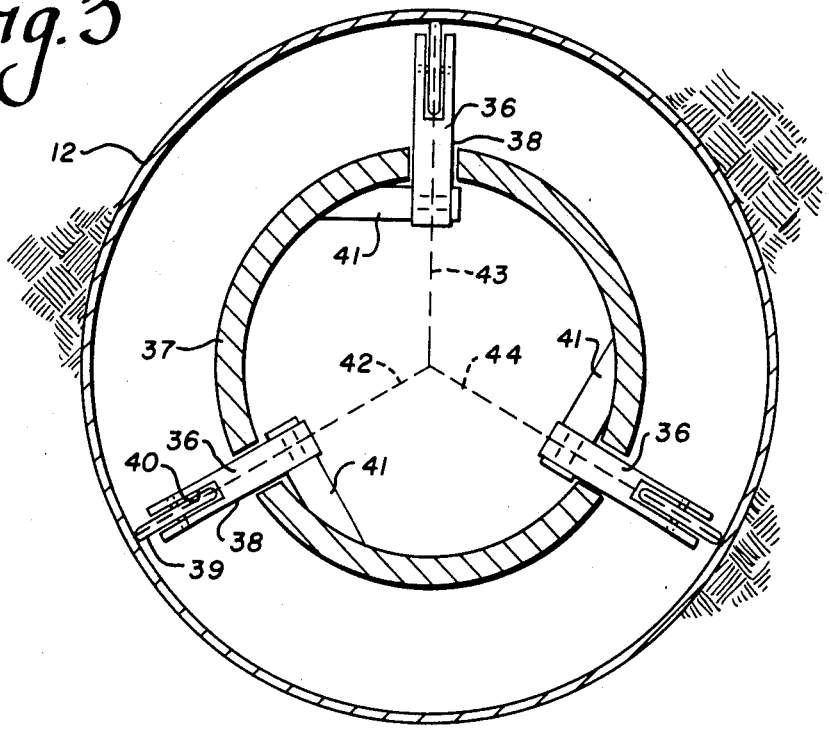
FIG. 3 is an enlarged schematic sectional view of a centralizer.

FIG. 3 is an enlarged schematic sectional view of a centralizer, such as centralizer 23, illustrating details of the arm construction. Three arms 36 are pivotally mounted within the interior of a housing 37 to project radially through slots 38 in the same for engagement with the inner surface of the casing 12. As illustrated, the slots 38 through which arms 36 extend are spaced equal distances apart about the periphery of the housing 37, and the arms project along radii from the axis of the centralizer, represented by dotted lines 39, 41 and 42 The arms themselves can be driven in any well known manner from inside the centralizer, such as by a rack and pinion drive, cams, or wires and drums, that will force the same to move together. Preferably, they will be locked in the retracted position while the component assembly is being lowered into a well, released after passing through the landing nipple portion of the tailpipe section and again locked in the retracted position when the component assembly is retracted through the landing nipple. This can be accomplished by including, for example, light spring loaded "feelers" which could sense the exit and entry, respectively, of the component assembly relative to the tailpipe and perform the unlocking and locking of the crank arms. This is advantageous in that the ability to lock the arms during installation and removal of the component assembly in a bore will virtually eliminate the danger of the same getting caught during movement by casing inner wall discontinuities such as by large nipples, side-pocket mandrels, etc. while greatly reducing wear. The free ends of the arms 36 which engage the inner surface of the casing wall can be of different constructions, so long as the construction will provide the desired contact. A suitable construction is illustrated in FIG. 3 in which a wheel 39 is provided journalled within a slot 40 in each arm end, the wheel being free to rotate and providing the engagement with the casing. As illustrated, one of the ends of each of the arms 36 is pivotally mounted on an associated projection 41 from the interior wall of the centralizer. As illustrated, such arms extend along radii 42, 43 and 44 to the borehole boundary provided by the interior surface of the casing 12.

Figure 4:
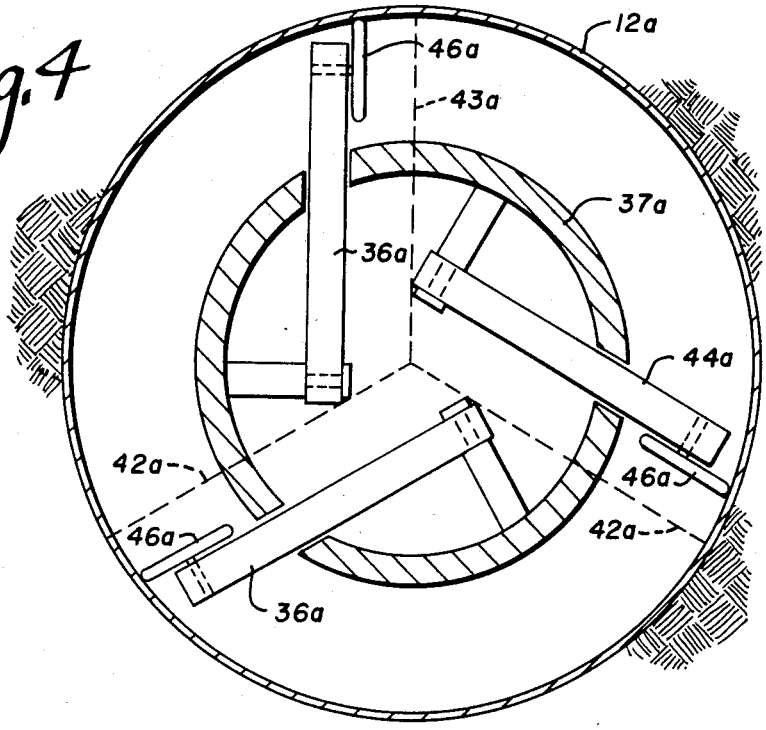
FIG. 4 is an enlarged schematic sectional view of an alternative design for centralizer arms.
Figure 5:
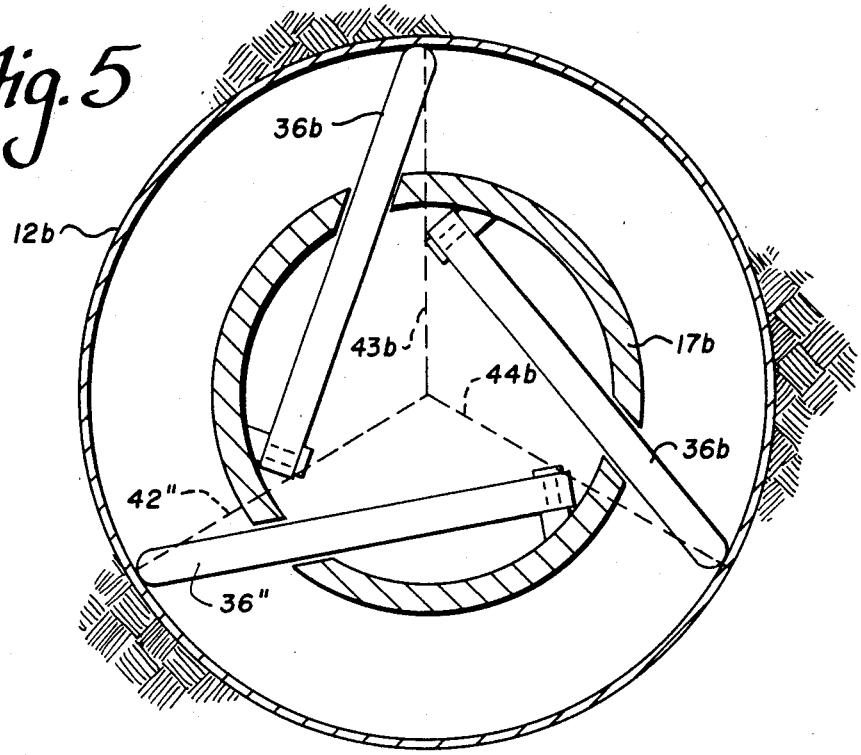
FIG. 5 is an enlarged schematic sectional view showing a third design for arms of a centralizer.

FIGS. 4 and 5 illustrate other centralizer-arm constructions, simply to make it clear that various constructions will suffice for the instant invention. In FIG. 4, the arms 36*a* are longer than the corresponding arms of the FIG. 3 construction, and thereby provide more leverage. Such arms are parallel to radii 42*a*–44*b* rather than falling along the same. The result is that the arms engage the casing angularly with respect to a line or plane which is tangent to the casing at the point of engagement.

As previously mentioned, the free ends of the arms which provide casing engagement can be of different constructions. FIG. 4 illustrates utilization of wheels 46*a*, each of which is journalled in a respective one of the arm ends for rotation on the side of its associated arm.

In the construction of FIG. 5, the arms 36*b* are illustrated as relatively long for leverage but extending through and from the centralizer housing 17*b* at an angle to the radii 42–44*b*. Moreover, the free ends of the arms 36*b* are shown in direct engagement with the borehole casing wall 12*a*, rather than being provided with a wheel for such engagement. As mentioned previously, it is only necessary that axial movement of the casing relative to the centralizer be accomodated when the component assembly is introduced into, or extracted from, the borehole.

Figure 6:
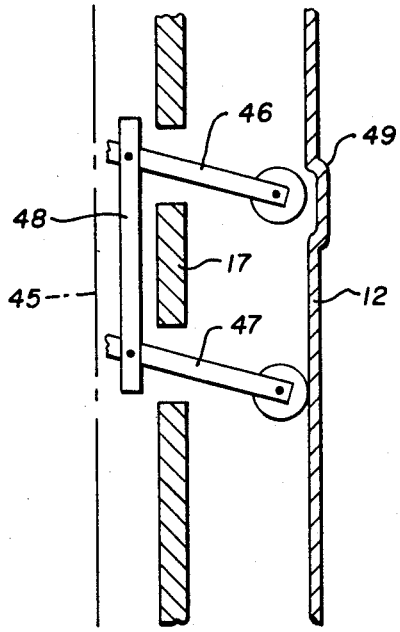
FIG. 6 is another enlarged schematic sectional view showing an alternate construction for centralizer arms.

In some environments, it will be desirable to assure that discontinuities in a borehole casing will not interfere with movement of the centralizer in such casing with its arms extended. FIG. 6 schematically illustrates an alternate arm construction for a centralizer to inhibit sticking at a discontinuity which increases the radius of the casing at a particular point, such as at a joint. (This schematic representation illustrates only one arm portion of a centralizer—the center line is represented at 45.) In such construction, two or more arms are substituted for each individual arm 36, such arms being axially in align with one another. These arms are tied together by, for example, a link 48 within the housing 17 of a centralizer.

Because the arms 46 and 47 are tied together, they will pivot in unison. Thus, as illustrated, the arm 47 will keep the arm 46 from falling into a discontinuity in the casing 12 schematically represented at 49.

In some constructions it may be desirable that only one of the two arms of a tandem arrangement, as shown in FIG. 6, normally be in contact with a casing wall, the other arm simply being a "safety" arm to prevent sticking at discontinuities. The construction can be modified by, for example, having one of the arms 46 or 47 somewhat shorter and/or with an end wheel of smaller diameter than the other, to accomplish this purpose.

Flexible joints 32 and 33 could be of various different constructions as long as they allow free pivotal movement in any direction of the section 19. Suitable flexible joints are known in the art. For example, the joint could be a bellows whose axial motion is suitably limited, mechanically. Other flexible joint designs can be used, such as ball-and-socket, cross-axis universal, chain link, wire braid, etc. to provide the desired free angular direction movement.

Figure 2:
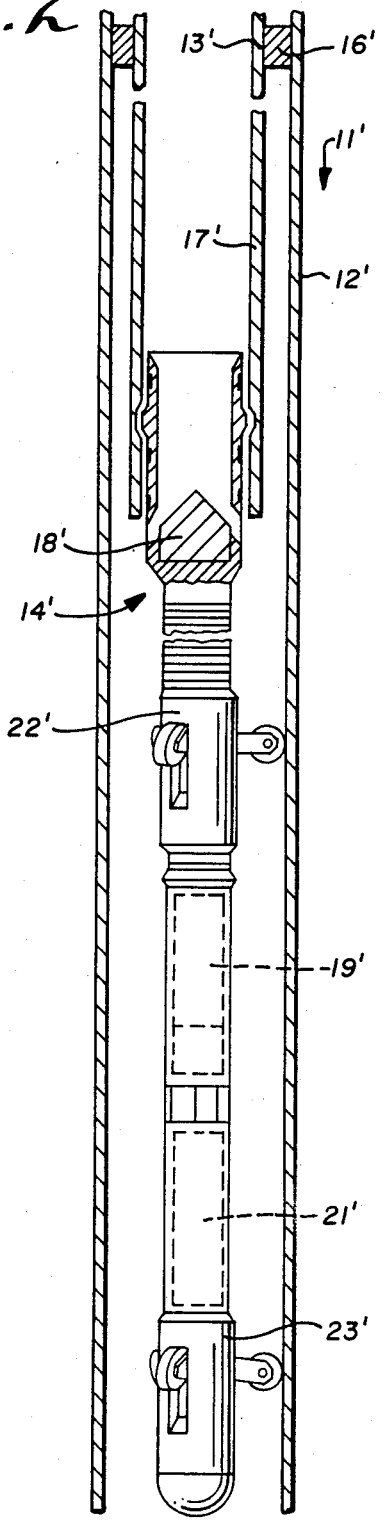
FIG. 2 is an idealized schematic, sectional view of an alternative embodiment of the apparatus of the invention.

As also mentioned previously, the embodiment of the invention illustrated in FIG. 1 is particularly designed for use within production environments in which relatively long, e.g., 10 meters or more, tailpipe sections are provided on the production tubing. An embodiment of the invention particularly adapted for use with short tailpipe sections is illustrated in FIG. 2. When the tailpipe section itself is short, the frequency of its vibrations are generally too high to interfere with the communication signal. Thus, the embodiment of the invention as illustrated in FIG. 2 will provide the desired isolation and relative orientation arrangement with the borehole.

Components shown in FIG. 2 having a similar or same function as those components described in connection with the embodiment shown in FIG. 1 are referred to by the same reference numerals, primed. A pair of centralizers 22′ and 23′ are provided at opposite ends of the component to be stabilized. In this embodiment, however, the centralizer 22′ is positioned at the upper end of the housing for the electronic section 19′, with the result that such electronics section also is stabilized. A flexible joint 51′ to isolate the stabilized component is provided between the valve 18′ and the centralizer 22′. Such flexible joint will isolate the stabilized section including the sensor 21′ from movement of, and forces on, the tailpipe section 17′. Ideally, the centralizer 22′ would provide engagement between the borehole casing and the component assembly at the same location transverse of the axis of the borehole as that of flexible joint 51′. It will be apparent from this embodiment that in some situations in order to achieve isolation it is not necessary that two flexible joints with a rigid section therebetween be provided. In some applications, particularly those with short tailpipes, it may be possible, depending largely upon other factors in the design, to dispense with use either of a flexible joint corresponding to flexible joint 51′, a stabilizer corresponding to centralizer 22′, or both. That is, in some designs the tailpipe section itself will provide stabilization and it is not necessary and, indeed, can be detrimental to decouple the component from such section. Moreover, the short tailpipe section can itself act as means for maintaining a constant displacement between one end of the component and the boundary of the borehole. The tailpipe section may or may not be stabilized by packing or the like.

Although the invention has been described in connection with preferred embodiments thereof, it will be apparent to those skilled in the art that various changes and modifications can be made. It is therefore intended that the coverage provided applicant be determined only by the claims and their equivalents.

We claim:

1. Apparatus for maintaining a communication sensor for receiving and reacting to an electromagnetic signal from an external source at a fixed angular orientation relative to a borehole within which said communication sensor resides comprising:

means for maintaining a constant lateral displacement between a first end of said communication sensor and the boundary of said borehole adjacent said end; and means for maintaining a constant lateral displacement between the opposite end of said communication sensor and the boundary of said borehole adjacent said opposite end.

2. The apparatus of claim 1 wherein each of said means for maintaining an end of said communication sensor at a constant lateral displacement allows pivotal motion of said end relative to said borehole, characterized in that said means are spaced from one another to prevent pivotal motion of said communication sensor relative to said borehole.

3. The apparatus of claim 1 further including means for decoupling said communication sensor from motion of, and forces on said member urging all or part of the communication sensor toward a different angular orientation than said fixed orientation.

4. The apparatus of claim 3 wherein said means for decoupling said communication sensor from movement of, and forces on, said member includes means for isolating said communication sensor from said movement and forces.

5. The apparatus of claim 1 wherein each of said means for maintaining an end of said communication sensor at said constant lateral displacement maintains said end centrally along the axis of said borehole, whereby said communication sensor is maintained centrally along said axis.

6. The apparatus of claim 1 wherein at least a portion of said communication sensor is suspended in said borehole characterized in that each of said means also is part of said suspended portion.

7. The apparatus of claim 1 wherein said sensor is responsive to the magnetic component of an electromagnetic signal received thereby.

8. The apparatus of claim 2 wherein each of said means for maintaining an end of said communication sensor at a constant lateral displacement includes a stabilizing mechanism which engages said borehole adjacent an end of the communication sensor to be maintained in said fixed orientation.

9. The apparatus of claim 8 wherein said sensor is responsive to the magnetic component of an electromagnetic signal received thereby.

10. The apparatus of claim 8 wherein said communication sensor is part of a suspended portion of a member positioned within said borehole, which suspended portion includes at least sections, a first one of which includes said sensor and is provided at opposite ends with said stabilizing mechanisms, and the second one of which includes means for decoupling said first section from motion of, and forces on, said member urging all or part of the same toward a different angular orientation than said fixed orientation.

11. The apparatus of claim 10 wherein said means for decoupling said first section includes at opposite ends of said second section, flexible joints permitting free angular orientation of said section relative to said first section.

12. Apparatus for maintaining a communication sensor for receiving and reacting to an electromagnetic signal from an external source and that is a part of a suspended portion of a member extending in a borehole at a fixed angular orientation relative to said borehole, comprising:

means for maintaining at least two locations of said suspended portion at constant lateral displacements from the boundary of said borehole and means for decoupling said suspended portion from motion of, and forces on, said member urging the same toward a different angular orientation.

13. Apparatus according to claim 12 wherein said sensor is responsive to the magnetic component of an electromagnetic signal received thereby.

14. A method of minimizing stray noise and interference picked up by a communication sensor for receiving and reacting to an electromagnetic signal from external source and that is a part of a relatively rigid member extending in a borehole by maintaining the communication sensor at a fixed angular orientation relative to said borehole, comprising the steps of:

orienting said communication sensor in a fixed orientation;

maintaining a first end of said communication sensor at a constant lateral displacement from the boundary of said borehole adjacent said end; and maintaining the opposite end of said communication sensor at a constant lateral displacement from the boundary of said borehole adjacent said opposite end.

15. The method of claim 14 further including the step of decoupling said communication sensor from motion of, and forces on, said member urging all or part of the communication toward a different angular orientation.

16. The method of claim 14 wherein said steps of maintaining ends of said communication sensor at constant lateral displacementS from said boundary of the borehole includes maintaining said ends centrally along the axis of said borehole.

17. The method of claim 14 wherein each of said steps of maintaining an end of said communication sensor at a constant lateral displacement includes providing a stabilizing mechanism for engaging said borehole at an end of the communication sensor to be maintained at a fixed distance.

18. The method of claim 17 further including the step of decoupling said communication sensor from motion of, and forces on, said member urging all or part of the same toward a different angular orientation.

19. The method of claim 18 wherein said component includes at least two section portions, a first one of which includes said communication sensor and is provided at opposite ends with said stabilizing mechanisms, and wherein said step of decoupling said communication sensor includes the steps of interposing said second section portion between said first section portion and said member and providing at opposite ends of said second section portion, flexible joints permitting free angular orientation of said second section portion relative to said first section portion.

20. Apparatus for maintaining a communication sensor of a component assembly suspended in a borehole from a tailpipe section of production tubing at a fixed angular orientation relative to said borehole, which component assembly further includes a valve for controlling the flow of fluid into said production tubing located between said sensor and the production tubing, comprising:

a stabilizing mechanism adjacent said valve engaging the boundary of said borehole thereat to maintain the same centrally along the borehole;

a section of said component assembly positioned between said valve and said sensor;

a pair of flexible joints at opposite ends of said section connecting the same to the remainder of said component assembly and permitting free angular orientation of said section relative to said tailpipe; and a pair of centralizers at opposite ends of the housing for said sensor engaging the borehole at locations adjacent said opposite ends and connecting said sensor to the remainder of said component assembly.

* * * * *